US006316115B1

(12) United States Patent
Lai et al.

(10) Patent No.: US 6,316,115 B1
(45) Date of Patent: Nov. 13, 2001

(54) NON-CHROMATE CHEMICAL TREATMENTS USED ON MAGNESIUM ALLOYS

(75) Inventors: Tzu-Yang Lai; Kuo-Lun Huang; Yung-Chien Lin; Huey-Jong Guo, all of Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/488,188

(22) Filed: Jan. 20, 2000

(30) Foreign Application Priority Data

Oct. 21, 1999 (TW) ..... 88118244

(51) Int. Cl.[7] ..... B32B 15/04; C23C 22/34; C23G 1/12

(52) U.S. Cl. ..... 428/469; 148/273; 148/275; 148/283; 148/285; 428/628; 428/629; 510/254; 510/257; 510/258

(58) Field of Search ..... 510/254, 257, 510/258; 428/469, 628, 629; 148/273, 275, 283, 285; 106/14.14, 316, 401, 499

(56) References Cited

U.S. PATENT DOCUMENTS 2,313,753 * 3/1943 Loose ..... 148/275
3,010,854 * 11/1961 Satterfield ..... 510/258

FOREIGN PATENT DOCUMENTS 57-41376-A * 3/1982 (JP) ..... 148/275
6-29235-A * 2/1994 (JP) ..... H01L/21/28

* cited by examiner

*Primary Examiner*—Robert R. Koehler
(74) *Attorney, Agent, or Firm*—Wei Te Chung

(57) ABSTRACT

Formulations and a process are disclosed for chemically treating a surface of a product made from magnesium alloys. One formulation comprises an acid pickle comprising hydrofluoric acid and a binary alcohol and a second formulation comprises a conversion solution comprising nitric acid, permanganate, and ammonium acid difluoride. The process comprises degreasing the product with alkaline solution, rinsing the product with water, pickling the product with the acid pickle, rinsing the product with water, modifying the product using the modifying solution, rinsing the product with purified water, and drying the product by heating.

14 Claims, No Drawings

NON-CHROMATE CHEMICAL TREATMENTS USED ON MAGNESIUM ALLOYS

BACKGROUND OF THE INVENTION

1. Field of the Invention

The present invention relates to finishing operations for products made from magnesium alloys, and particularly to non-chromate chemical treatments which form a protective film to protect the product from surface corrosion.

2. Description of the Prior Art

Magnesium alloys have many advantages, such as low density, high thermal conductivity and high conductivity of the surface thereof. Because magnesium alloys can comply with the trend forward lighter, thinner, shorter, and smaller fittings having better heat dissipation and improved EMI shielding characteristics for electronic apparatus, magnesium alloys is replacing plastics and become the newest popular material of mobile computer, consumer and mobile communication electronic products. However, magnesium alloys are vulnerable to oxidation in air, so the surfaces of the alloys need a protective film for inhibiting corrosion.

Chromate is normally used to chemically modify surfaces of products made from magnesium alloys. Such as the chemical treatment operations for magnesium alloys proposed by Dow Chemical Company and U.S. Pat. No. 4,676,842 disclose the use of chromate to chemically modify metallic materials, which forms a compact protective film inhibiting the corrosion on surfaces of magnesium alloys. Chromic ions ($Cr^{3+}$) in the film and the acid pickle are poisonous and dangerous pollutant to the environment and result in recycling difficulties of magnesium alloys and increased cost of manufacture and waste handling. Since chromic ions ($Cr^{3+}$) are to be banned from use in the near future, a reliable operation without using chromate is desired.

SUMMARY OF THE INVENTION

An object of the present invention is to overcome the shortcomings of the prior art by providing a non-chromate chemical conversion coating to the surfaces of magnesium alloys to inhibit corrosion on the surfaces.

Another object of the present invention is to provide a non-chromate operation to reduce environmental pollution.

Another object of the present invention is to provide a process using non-chromate formulations, which operates at a lower temperature and reduces cost.

Two formulations in accordance with the present invention comprise an acid pickle prepared mainly from hydrofluoric acid and a binary alcohol, and a conversion solution prepared mainly from nitric acid, permanganate, and ammonium acid difluoride.

A process in accordance with the present invention which uses the new formulations follows. A specimen composed of a magnesium alloy is initially immersed into an alkaline solution at 333.15~343.15 degrees Kelvin for 3~5 minutes for degreasing, and is then rinsed twice with purified water at ambient temperature. The rinsed specimen is then dipped in the prepared acid pickle at ambient temperature for 0.5~1.5 minutes. After acid pickling, the specimen is rinsed twice with purified water at ambient temperature. Following the fourth rinsing the specimen is immersed into the prepared conversion solution at 293.15~333.15 degrees Kelvin for 0.5~1.5 minutes to form a compact protective film on the surface of the specimen. The modified specimen is rinsed for a fifth and sixth times using purified water at ambient temperature. Following the final rinse, the specimen is dried at 333.15~343.15 degrees Kelvin for 50 minutes. Except for the drying step, at least one of the above steps includes an environment with ultrasonic waves. Each of the rinsing steps consumes 10~20 seconds.

Other objects, advantages and novel features of the invention will become more apparent from the following detailed description of the preferred embodiment.

DESCRIPTION OF THE PREFERRED EMBODIMENT

In a chemical treatment operation in accordance with the present invention, an acid pickle solution and a conversion solution are used in the process. The below two tabulations are listings of those substances (together with their percentage by weight) that make up formulations of the acid pickle and the conversion solutions in accordance with the present invention.

| Substance | Approximate Percentage by Weight |
|---|---|
| Acid Pickle Solution Formulation | |
| Deionized water | Q.S. % |
| Hydrofluoric Acid | 1.6% |
| Ethylene Glycol | 3% |
| Conversion Solution Formulation | |
| Deionized water | Q.S. % |
| Nitric Acid | 0.325% |
| Potassium Permanganate Dibasic | 3% |
| Ammonium Hydrogen Difluoride | 0.5% |

In the preferred embodiment, a concentration by weight of the hydrofluoric acid is 40% and a concentration by weight of the nitric acid is 65%. Weigh 40 grams of hydrofluoric acid (40% HF) and 30 grams of ethylene glycol ($C_2H_4O_2$) at ambient temperature using an electronic scale and mix the two in a container, adding an appropriate quantity of purified water to the mixture to just adequately inter-dissolve the components while stirring. Dilute the solution with an appropriate quantity of purified water to get 1 liter of acid pickle. Also weigh precisely 5 grams of nitric acid (65% $HNO_3$), 30 grams of potassium permanganate dibasic ($KMnO_4$), and 5 grams of ammonium acid difluoride ($NH_4 \cdot HF_2$) at ambient temperature using an electronic scale and mix them with a proper quantity of purified water for just adequately inter-dissolving upon being stirred. Dilute the solution using an appropriate quantity of purified water to get 1 liter of conversion solution. Percentages by weight of the components of the above solutions may vary in a range of −5%~+5%.

A specimen composed of a magnesium alloy is initially immersed into a pre-cleaning solution comprising alkaline solution and surfactants at 333.15~343.15 degrees Kelvin for 3~5 minutes to remove forming lubricant, fingerprints, and other organic deposits on the surface of the specimen. Then the specimen is rinsed twice with purified water at ambient temperature to eliminate residual pre-cleaning solution and molecular grease on the surface thereof. The rinsed specimen is immersed into the prepared acid pickle at ambient temperature for 0.5~1.5 minutes to slightly etch the surface of the specimen and get rid of oxides on the surface thereby exposing the surface for direct contact with the modifying solution in a following step. The acid pickle can also neutralize the possibly residual alkali materials of the pre-cleaning solution. The specimen is rinsed twice with purified water at ambient temperature after acid pickling to eliminate the remainder of particulate oxides, resultants and residual acid pickle on the surface thereof. The fourth rinsed specimen is immersed into the prepared conversion solution at 293~333 degrees Kelvin for 0.5~1.5 minutes to form a compact protective film on the surface of the specimen. The modified specimen is rinsed twice using purified water at ambient temperature for eliminating residual test solutions. Finally the specimen is dried at a temperature of 333~343 degrees Kelvin for 50 minutes. Except for the drying step, all of the above steps include an environment with ultrasonic waves. The frequency of the ultrasonic waves is about 28 K Hz. All of the rinsing steps are conducted for 10~20 seconds. The environment with ultrasonic waves can be obtained by using an ultrasonic cleaner which is well known by one skilled in the art of cleaning of mechanical components. The applied duration of the ultrasonic waves is equal to the duration of the corresponding step.

The present invention does not use the conventional chromate, so it reduces pollution, facilitates recycling of the magnesium alloy, and decreases handling costs. Additionally, as can be seen from the description above, operating temperatures of the processing steps of the present invention are far below those of the conventional art thereby further reducing cost.

It is to be understood, however, that even though advantages of the present invention have been set forth in the foregoing description, together with details of the invention, the disclosure is illustrative only, and changes may be made in detail within the principles of the invention to the full extent indicated by the broad general meaning of the terms in which the appended claims are expressed.

What is claimed is:

1. A formulation for acid pickling a product made from magnesium alloys, comprising: hydrofluoric acid and a binary alcohol.

2. The formulation in accordance with claim 1, wherein a percentage by weight of the hydrofluoric acid (HF) in the product formulation is 1.6%.

3. The formulation in accordance with claim 2, wherein a concentration by weight of the hydrofluoric acid is 40%.

4. The formulation in accordance with claim 1, wherein a percentage by weight of the binary alcohol is 3%.

5. The formulation in accordance with claim 1, wherein the binary alcohol is ethylene glycol ($C_2H_4O_2$) and a percentage by weight of the ethylene glycol ($C_2H_4O_2$) in the product formulation is 3%.

6. A formulation for chemically modifying a surface of a product made from magnesium alloys, comprising: nitric acid, potassium permanganate dibasic ($KMnO_4$) and ammonium hydrogen difluoride.

7. The formulation in accordance with claim 6, wherein a percentage by weight of the nitric acid ($HNO_3$) in the product formulation is 0.5%.

8. The formulation in accordance with claim 7, wherein a concentration by weight of the nitric acid is 65%.

9. The formulation in accordance with claim 6, wherein the percentage by weight of the potassium permanganate dibasic ($KMnO_4$) in the product formulation is 3% and the ammonium hydrogen difluoride is ammonium acid difluoride.

10. The formulation in accordance with claim 9, wherein the percentage by weight of the ammonium acid difluoride ($NH4.HF_2$) in the product formulation is 0.5%.

11. A process for chemically treating a product made from magnesium alloys, comprising the following steps: degreasing, rinsing, acid pickling, rinsing, conversion, rinsing, and drying, wherein:

(a) the degreasing step is conducted around 333.15~343.15 degrees Kelvin for 3~5 minutes;

(b) the acid pickling step is conducted at ambient temperature for 0.5~1.5 minutes without using chromate;

(c) the conversion step is conducted around 293.15~333.15 degrees Kelvin for 0.5~1.5 minutes without using chromate;

(d) the drying step is conducted around 333.15~343.15 degrees Kelvin for 50 minutes;

(e) the rinsing steps are all conducted at ambient temperature for 10~20 seconds using water; and (f) an ultrasonic wave environment is present in at least one of the above mentioned steps except for the drying step.

12. The process as claimed in claim 11, wherein an acid pickle used in the acid pickling step comprises hydrofluoric acid and a binary alcohol.

13. The process as claimed in claim 12, wherein a conversion solution used in the conversion step comprises nitric acid, permanganate, and ammonium acid difluoride.

14. A magnesium alloys plate comprising a raw sheet chemically treated by following steps: degreasing, rinsing, acid pickling, rinsing, conversion, rinsing, and drying, wherein:

(a) the degreasing step is conducted at 333~343 degrees Kelvin for 3~5 minutes;

(b) the acid pickling step is conducted at ambient temperature for 0.5~1.5 minutes using binary alcohol;

(c) the conversion step is conducted at 293~333 degrees Kelvin for 0.5~1.5 minutes without using chromate;

(d) the drying step is conducted at 333~343 degrees Kelvin for 50 minutes;

(e) the rinsing steps are all conducted at ambient temperature for 10~20 seconds using water; and (f) an ultrasonic wave environment is present in at least one of the above mentioned steps except for the drying step.

* * * * *